US012733718B2

(12) United States Patent
Ozawa

(10) Patent No.: US 12,733,718 B2
(45) Date of Patent: Sep. 15, 2026

(54) SLIDER

(71) Applicant: YKK CORPORATION, Tokyo (JP)

(72) Inventor: Takanori Ozawa, Toyama-ken (JP)

(73) Assignee: YKK CORPORATION, Tokyo (JP)

( * ) Notice: Subject to any disclaimer, the term of this patent is extended or adjusted under 35 U.S.C. 154(b) by 90 days.

(21) Appl. No.: 18/777,581

(22) Filed: Jul. 19, 2024

(65) Prior Publication Data

US 2025/0120481 A1 Apr. 17, 2025

(30) Foreign Application Priority Data

Oct. 12, 2023 (CN) ..... 202311318147.0

(51) Int. Cl.
*A44B 19/26* (2006.01)

(52) U.S. Cl.
CPC ..... *A44B 19/262* (2013.01)

(58) Field of Classification Search
CPC ..... A44B 19/262; A44B 19/306; A44B 19/26; A44B 19/30; Y10T 24/2571
See application file for complete search history.

(56) References Cited

U.S. PATENT DOCUMENTS

| | | | | |
|---|---|---|---|---|
| 8,959,728 | B2 * | 2/2015 | Ozawa | A44B 19/30 24/421 |
| 9,095,192 | B2 * | 8/2015 | Hamada | A44B 19/262 |
| 9,271,548 | B2 * | 3/2016 | Keyaki | A44B 19/26 |
| 9,993,049 | B2 * | 6/2018 | Miyazaki | A44B 19/262 |
| 10,085,527 | B2 * | 10/2018 | Hamada | A44B 19/262 |
| 12,478,146 | B2 * | 11/2025 | Miyazaki | A44B 19/262 |
| 2009/0288276 | A1 * | 11/2009 | Dhanapal | A44B 19/306 24/421 |
| 2025/0374999 | A1 * | 12/2025 | Chayahara | A44B 19/305 |

FOREIGN PATENT DOCUMENTS

| | | |
|---|---|---|
| CN | 201691193 | 1/2011 |
| EP | 3009026 | 8/2019 |
| JP | 5647730 | 1/2015 |
| WO | 2014199441 | 12/2014 |
| WO | 2024069666 | 4/2024 |

OTHER PUBLICATIONS

"Office Action of Germany Counterpart Application", issued on Feb. 27, 2026, p. 1-p. 7.

* cited by examiner

*Primary Examiner* — Jason W San
*Assistant Examiner* — Louis A Mercado
(74) *Attorney, Agent, or Firm* — JCIPRNET

(57) ABSTRACT

A slider includes a slider body, a lock pin, and a tab pull. The slider body has a pair of wall portions, a pin hole formed between the pair of wall portions, and a pedestal portion disposed on at least one side of the pin hole and on one of the pair of wall portions. The lock pin has a holding portion, a placement portion placed on the pedestal portion, and a pin portion extending downward and passing through the pin hole. One of the pedestal portion and the placement portion is provided with a limiting portion for limiting the placement portion in a width direction, and in an accommodating space, a void portion for the placement portion to move is disposed above the pedestal portion. The placement portion is spaced apart from an inner wall of one of the pair of wall portions to form the void portion.

10 Claims, 10 Drawing Sheets

SLIDER

CROSS-REFERENCE TO RELATED APPLICATION

This application claims the priority benefit of China application serial no. 202311318147.0, filed on Oct. 12, 2023. The entirety of the above-mentioned patent application is hereby incorporated by reference herein and made a part of this specification.

BACKGROUND

Technical Field

The present invention relates to the technology of the fastener field, and in particular to a slider.

Description of Related Art

A conventional fastener usually includes a fastener chain composed of a pair of strip-shaped fastener tapes and multiple element columns arranged on the fastener tapes, and a slider installed on the fastener chain to open or close the element columns through sliding, and a tab pull may also be disposed on the slider according to requirements. In addition, a lock pin may be disposed on the slider body of the slider to lock the slider on the fastener chain via the lock pin. For example, the lock pin extends downward through the pin hole of the slider body and is inserted into the element columns or the fastener tapes disposed on the fastener chain. The locking manner may vary depending on the type of the fastener, the slider, or the lock pin. Moreover, whether the lock pin is inserted may be linked with the tab pull. For example, when the tab pull is pulled to drive the slider, the tab pull simultaneously drives the lock pin to unlock. The unlocking manner may vary depending on the type of the fastener, the slider, or the lock pin.

Furthermore, in the prior art, the fastener chain is also provided with a separable pin and a retainer pin. The separable pin and the retainer pin are respectively disposed on the pair of fastener tapes and are located at the ends of the pair of element columns. Furthermore, the separable pin and the retainer pin may be engaged with each other to fix the end of the fastener chain. In this way, in the case where the slider is installed on the fastener chain, the slider opens or closes the element columns through sliding relative to the fastener chain. When the slider moves to the end of the fastener chain, the separable pin and the retainer pin are inserted into the slider body from bottom to top and respectively pass through an element channel. At this time, if the lock pin is disposed on one side of the slider body to prevent low locking strength such that the lock pin may be inserted into the element column on one side, the lock pin will interfere with the insertion of the separable pin. Correspondingly, if the lock pin is disposed at the center of the slider body to prevent interference of the lock pin with the insertion of the separable pin, the lock pin can only be inserted between the pair of element columns, thereby causing low locking strength. Therefore, it is necessary to improve structures such as the slider body and the lock pin of the slider.

Prior Art Literature

Patent Document

[Patent Document 1] Japanese Patent Publication No. 5647730

[Patent Document 2] China Utility Model Publication No. 201691193 U

The present invention provides a slider which can take into account both the locking strength of a lock pin and the insertion effect of a separable pin, thereby having good operability.

SUMMARY

The present invention provides a slider, which is suitable for being installed on a fastener chain and includes: a slider body, including an upper blade and a lower blade disposed opposite to each other and a guide column connecting the upper blade and the lower blade, and having an element channel located between the upper blade and the lower blade; a lock pin, disposed on the slider body; and a tab pull, disposed on the slider body and driving the lock pin to move. The slider body has a pair of wall portions disposed on the upper blade and forming an accommodating space for the lock pin, a pin hole formed between the pair of wall portions and communicated with the element channel, and a pedestal portion disposed on at least one side of the pin hole between the pair of wall portions and on one of the pair of wall portions to carry the lock pin. The lock pin has a holding portion held on a front side of the slider body, a placement portion on an opposite side of the holding portion and placed on the pedestal portion, and a pin portion extending downward from the placement portion and passing through the pin hole. One of the pedestal portion and the placement portion is provided with a limiting portion for limiting the placement portion in a width direction, and in the accommodating space, a void portion for the placement portion to move is disposed above the pedestal portion. The placement portion is spaced apart from an inner wall of one of the pair of wall portions to form the void portion.

In an embodiment of the present invention, the void portion is located above the limiting portion in an up-down direction.

In an embodiment of the present invention, the limiting portion is disposed on one side of the pedestal portion opposite to the pin hole and limits displacement of the placement portion relative to the pedestal portion in the width direction.

In an embodiment of the present invention, the limiting portion includes an inclined surface inclined downward toward the pedestal portion where the placement portion is placed on.

In an embodiment of the present invention, the limiting portion is disposed on one side of the placement portion adjacently connected to the pin portion and limits displacement of the placement portion relative to the pedestal portion in the width direction.

In an embodiment of the present invention, the limiting portion includes an inclined surface inclined downward from the placement portion toward the pin portion.

In an embodiment of the present invention, the placement portion and the pin portion are connected to each other to form an L-shaped structure, the pedestal portion is disposed on one side of the pin hole and on one of the pair of wall portions, so that the pin portion passes through the pin hole next to the pedestal portion, and the limiting portion is disposed between one of the pair of wall portions and the placement portion or disposed between the pin portion and the pedestal portion.

In an embodiment of the present invention, the placement portion and the pin portion are connected to each other to form a T-shaped structure, a pair of the pedestal portions are disposed on two opposite sides of the pin hole and on both of the pair of wall portions, so that the pin portion passes through the pin hole between the pair of the pedestal portions, and the limiting portion is disposed between one of the pair of wall portions and the placement portion or disposed between the pin portion and one of the pedestal portions.

In an embodiment of the present invention, the pin portion of the lock pin is offset relative to a centerline of the slider body and is capable of being inserted into one of a pair of element columns passing through the element channel.

Based on the above, in the slider of the present invention, one of the pedestal portion of the slider body and the placement portion of the lock pin is provided with the limiting portion for limiting the placement portion in the width direction, and in the accommodating space formed by the pair of wall portions of the slider body, the void portion for the placement portion to move is disposed above the pedestal portion, and the placement portion is spaced apart from the inner wall of one of the pair of wall portions to form the void portion. In this way, when the pair of element columns of the fastener chain pass through the element channel of the slider body, the pin portion of the lock pin may be inserted into the element column on one side for locking, and the placement portion may suppress the displacement in the width direction via the limitation by the limiting portion, thereby ensuring the locking strength of the lock pin. Correspondingly, when the separable pin of the fastener chain is inserted into the slider body and passes through the element channel, the pin portion of the lock pin may be pushed by the separable pin to rotate, so as to move past the limiting portion and move toward the void portion, thereby preventing the lock pin from interfering with the insertion of the separable pin. Accordingly, the slider of the present invention can take into account both the locking strength of the lock pin and the insertion effect of the separable pin, thereby having good operability.

In order for the features and advantages of the present invention to be more comprehensible, the following embodiments are specifically illustrated below in conjunction with the drawings.

DESCRIPTION OF THE EMBODIMENTS

Figure 1:
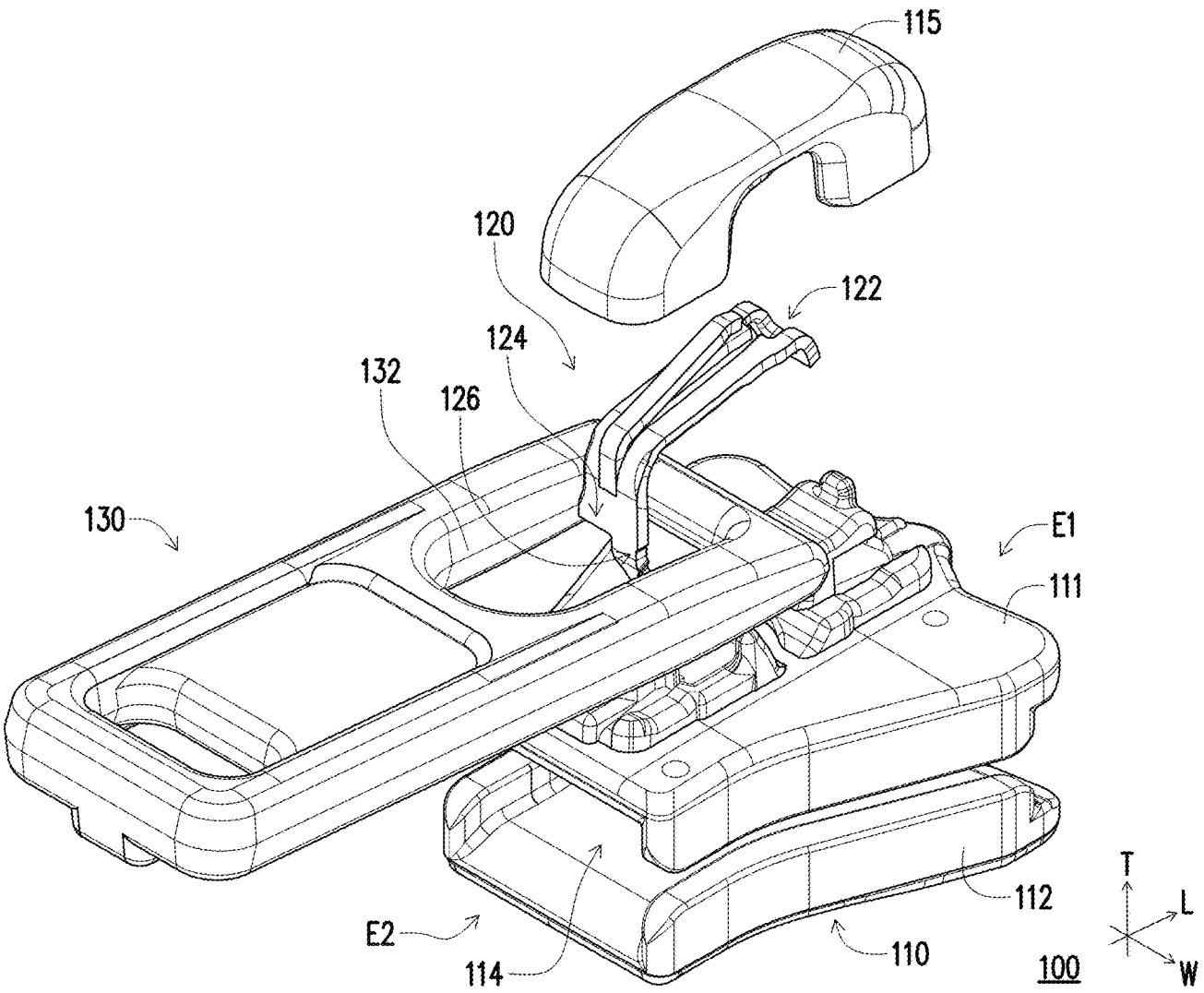
FIG. 1 is an exploded schematic view of a slider according to an embodiment of the present invention.
Figure 2:
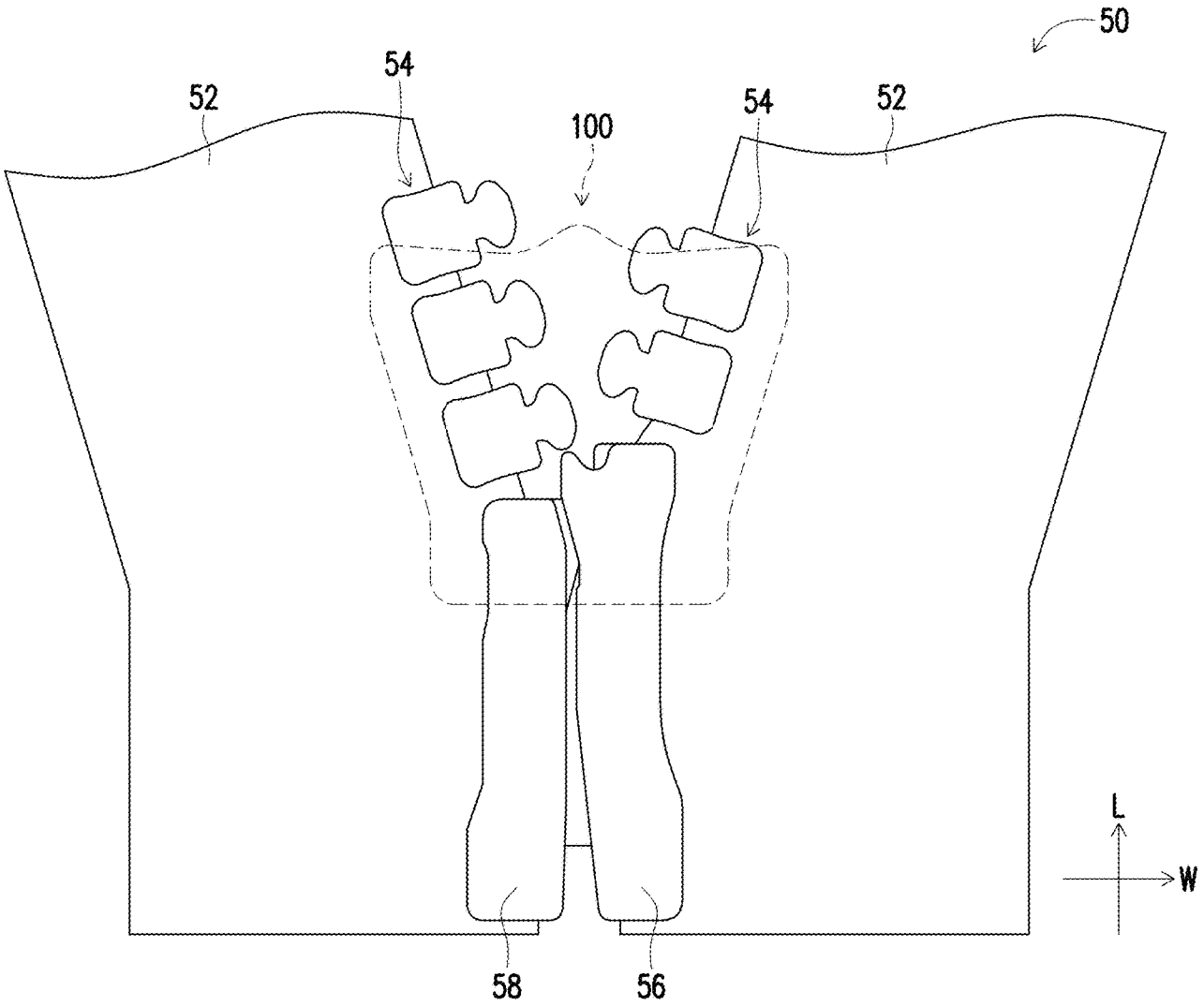
FIG. 2 is a plan schematic view of a fastener chain provided with a separable pin applicable to the slider shown in FIG. 1.
Figure 3:
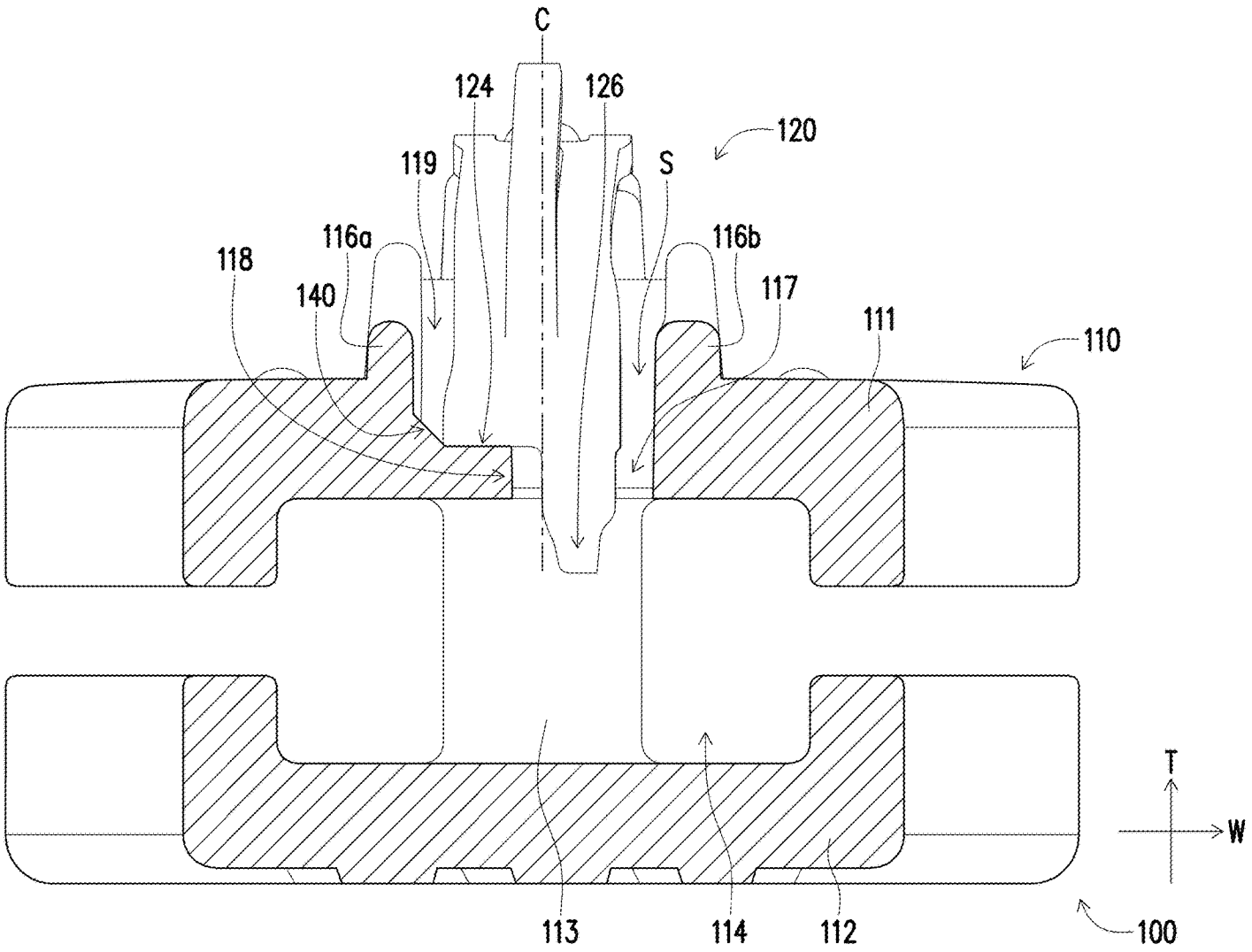
FIG. 3 is a cross-sectional schematic view of a local structure in the slider shown in FIG. 1.
Figure 4:
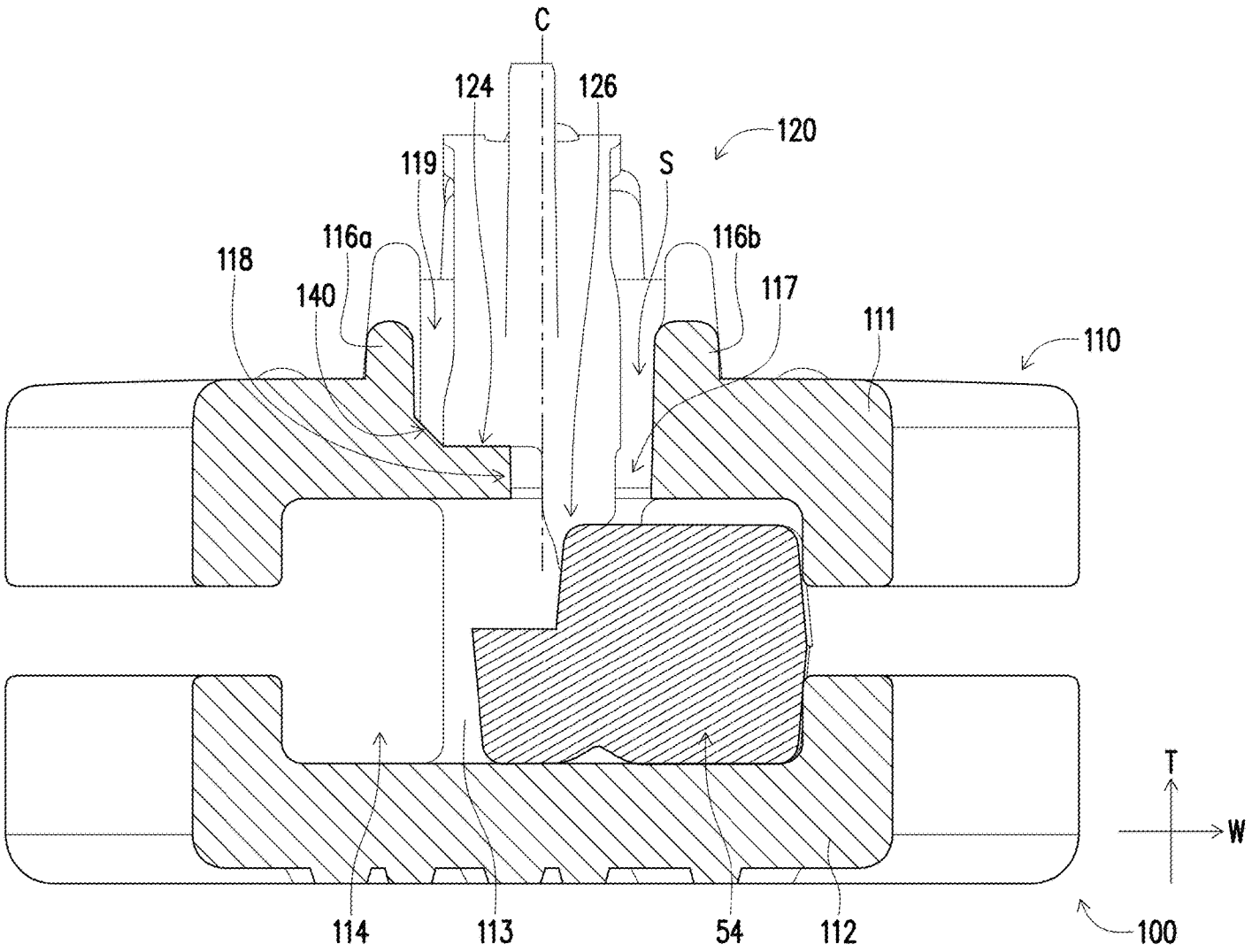
FIG. 4 is a cross-sectional schematic view of a pin portion of a lock pin of the slider shown in FIG. 3 being inserted into an element column passing through an element channel.
Figure 5:
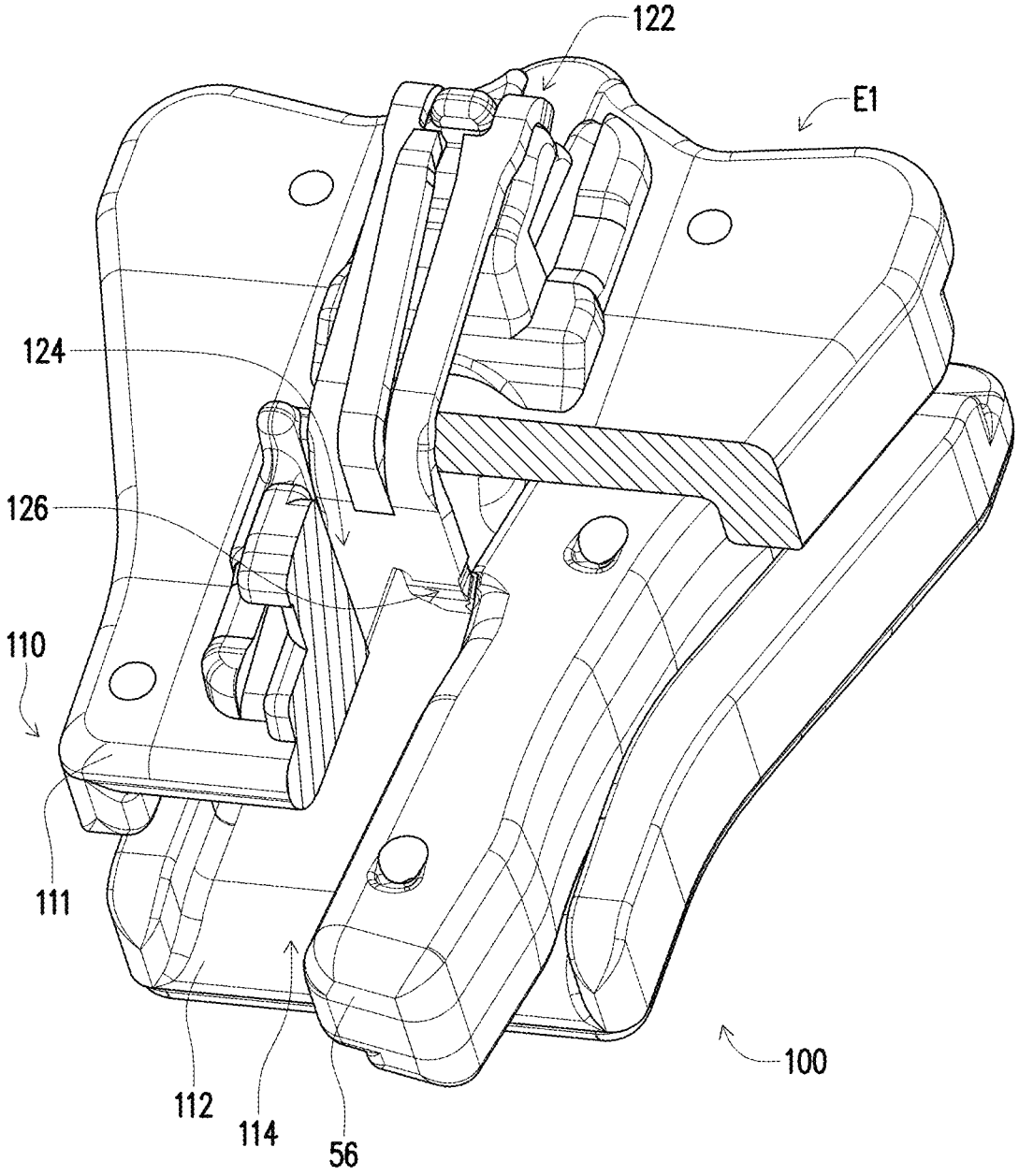
FIG. 5 is a partially cut three-dimensional schematic view of the slider shown in FIG. 3 when the separable pin is inserted into the element channel.
Figure 6:
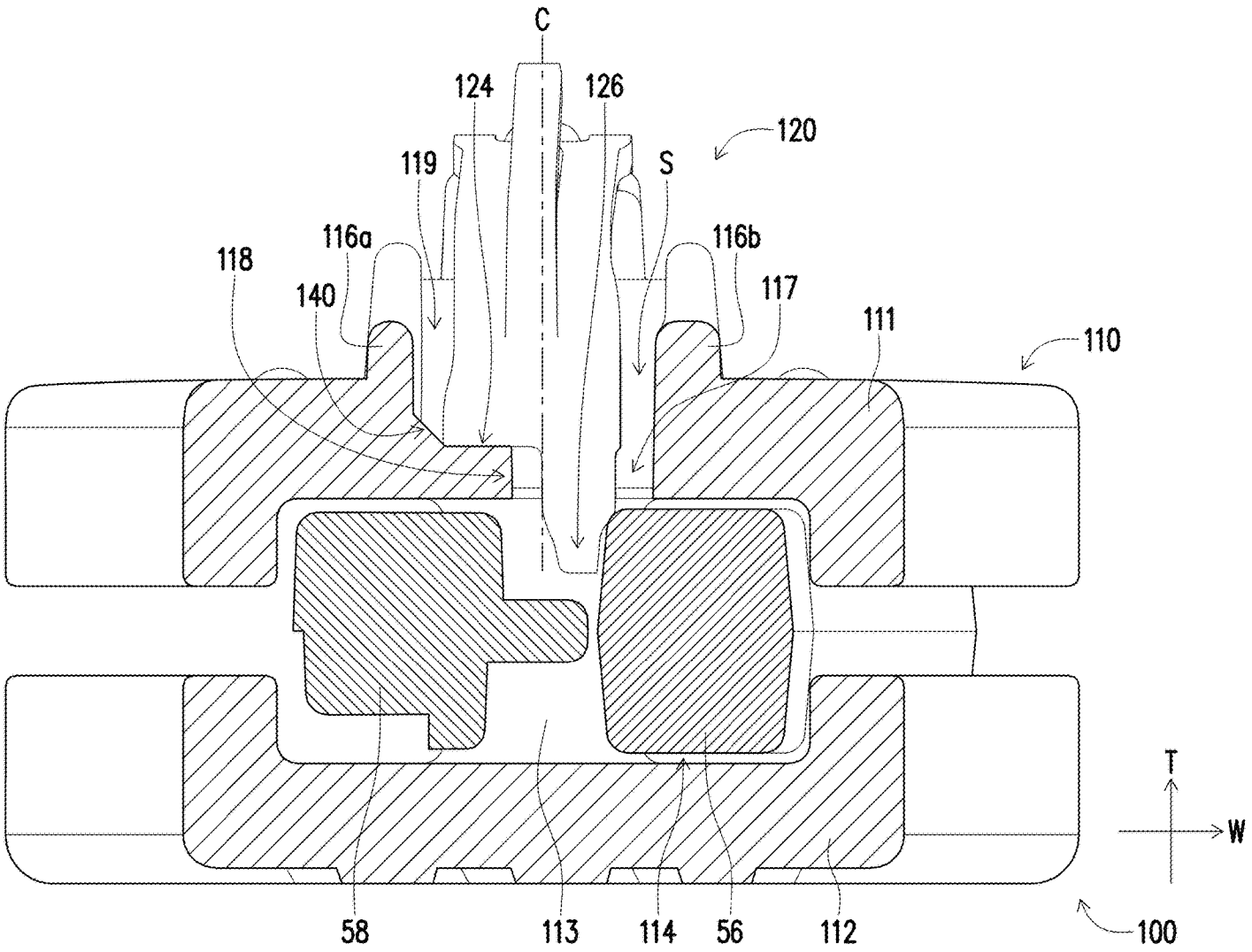
FIG. 6 is a cross-sectional schematic view of the slider shown in FIG. 3 when the separable pin is inserted into the element channel.
Figure 7:
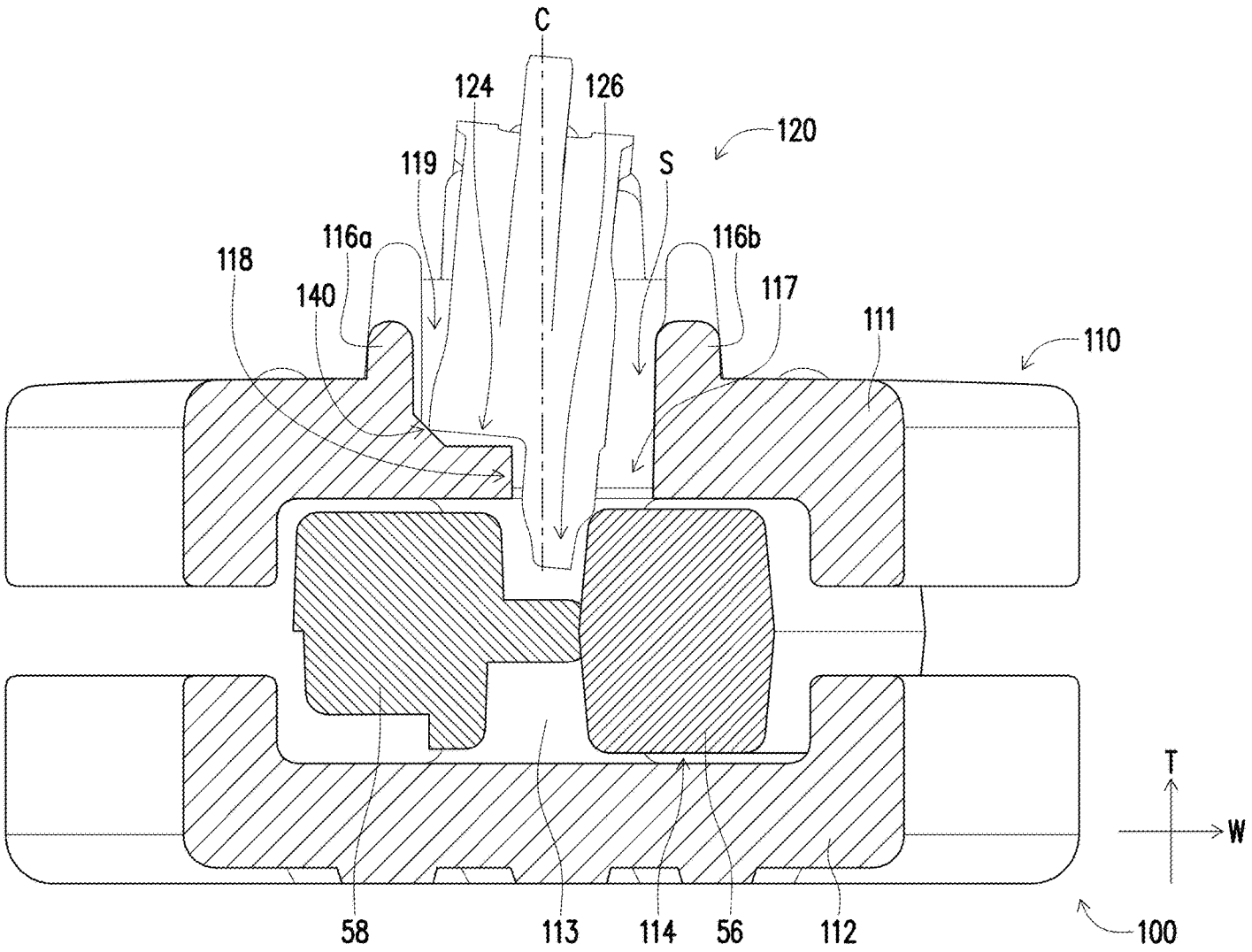
FIG. 7 and FIG. 8 are operational schematic views of the pin portion of the lock pin of the slider shown in FIG. 6 when the separable pin is inserted into the element channel.
Figure 8:
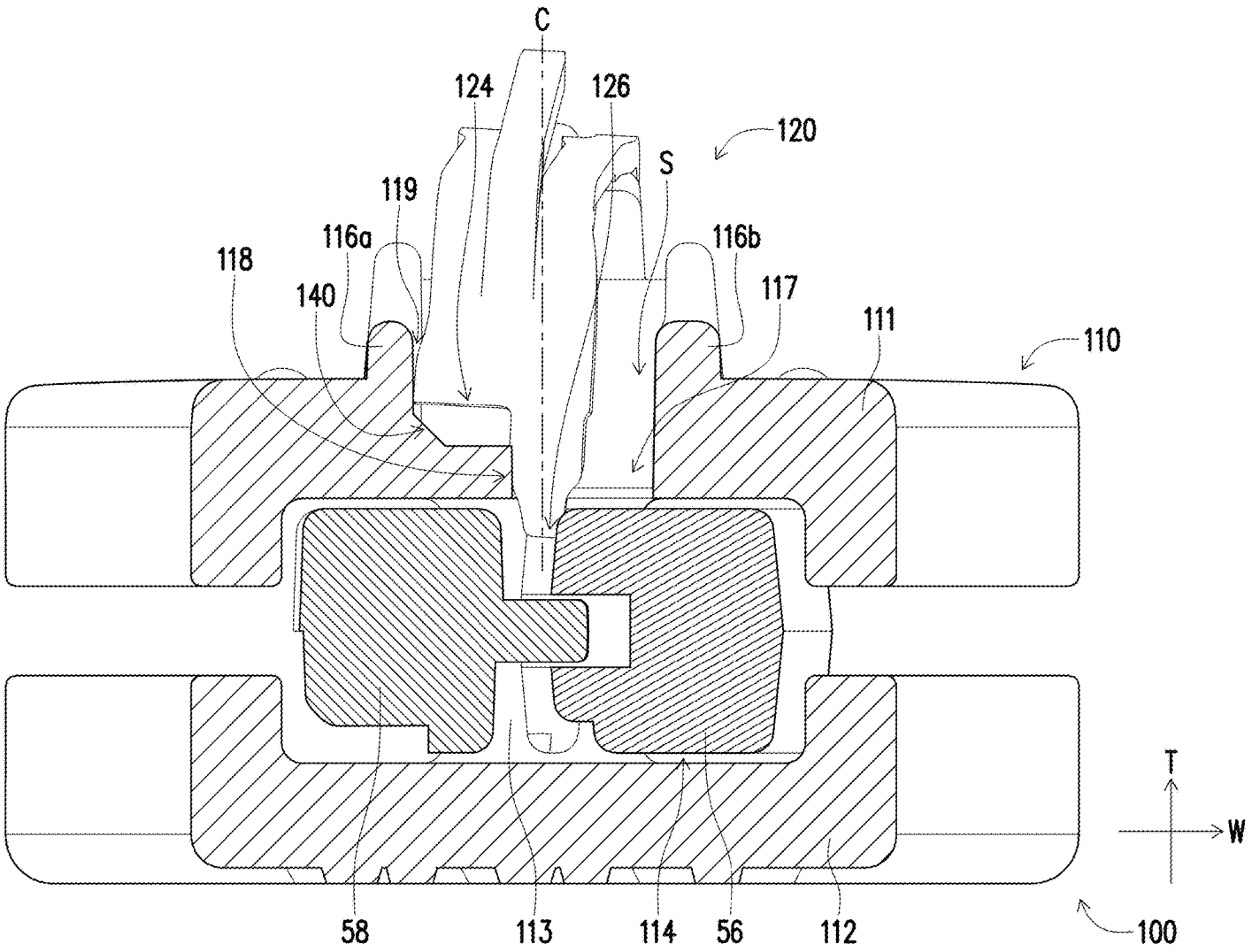
Figure 9:
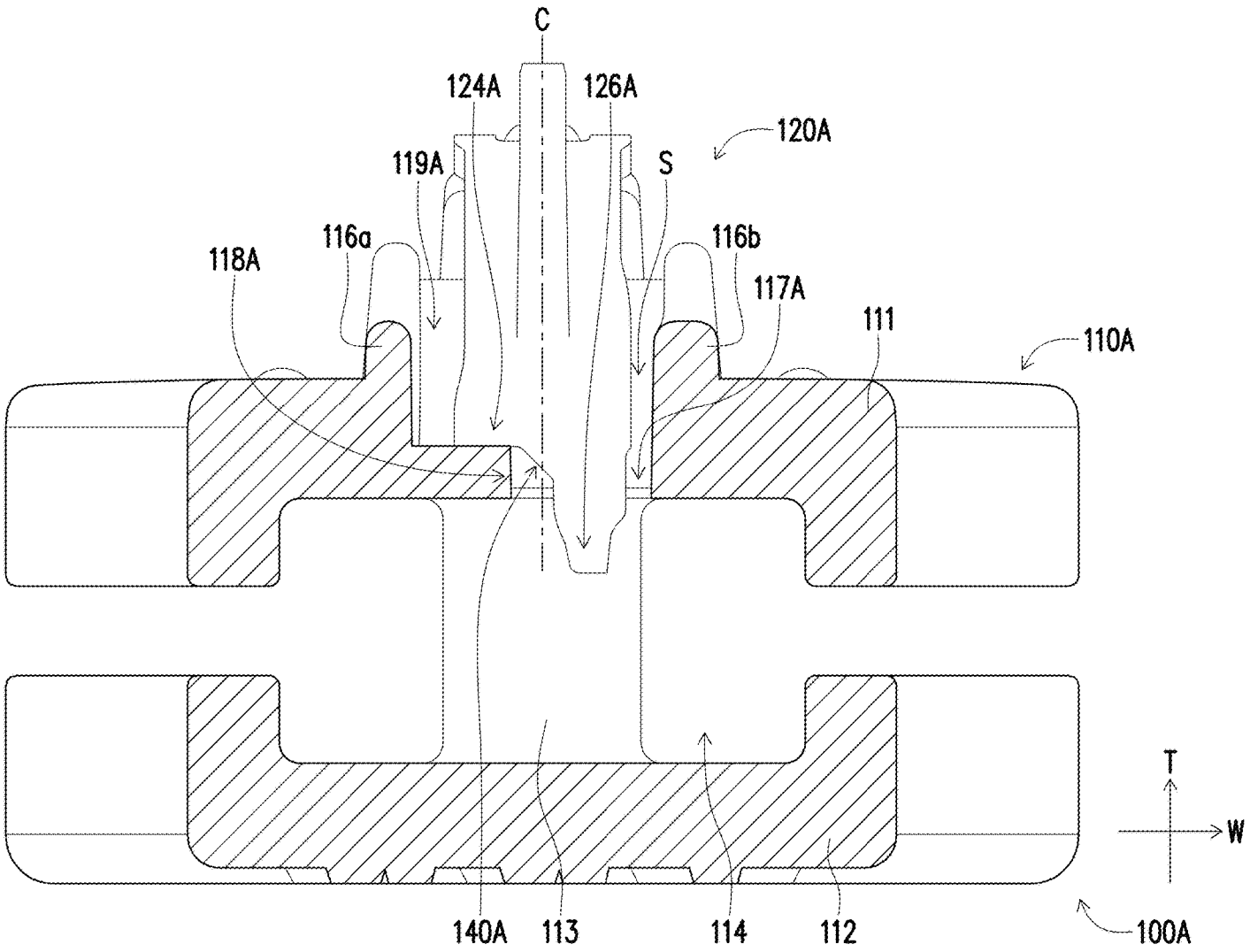
FIG. 9 is a cross-sectional schematic view of a local structure in the slider shown in FIG. 3 in a first modified example.
Figure 10:
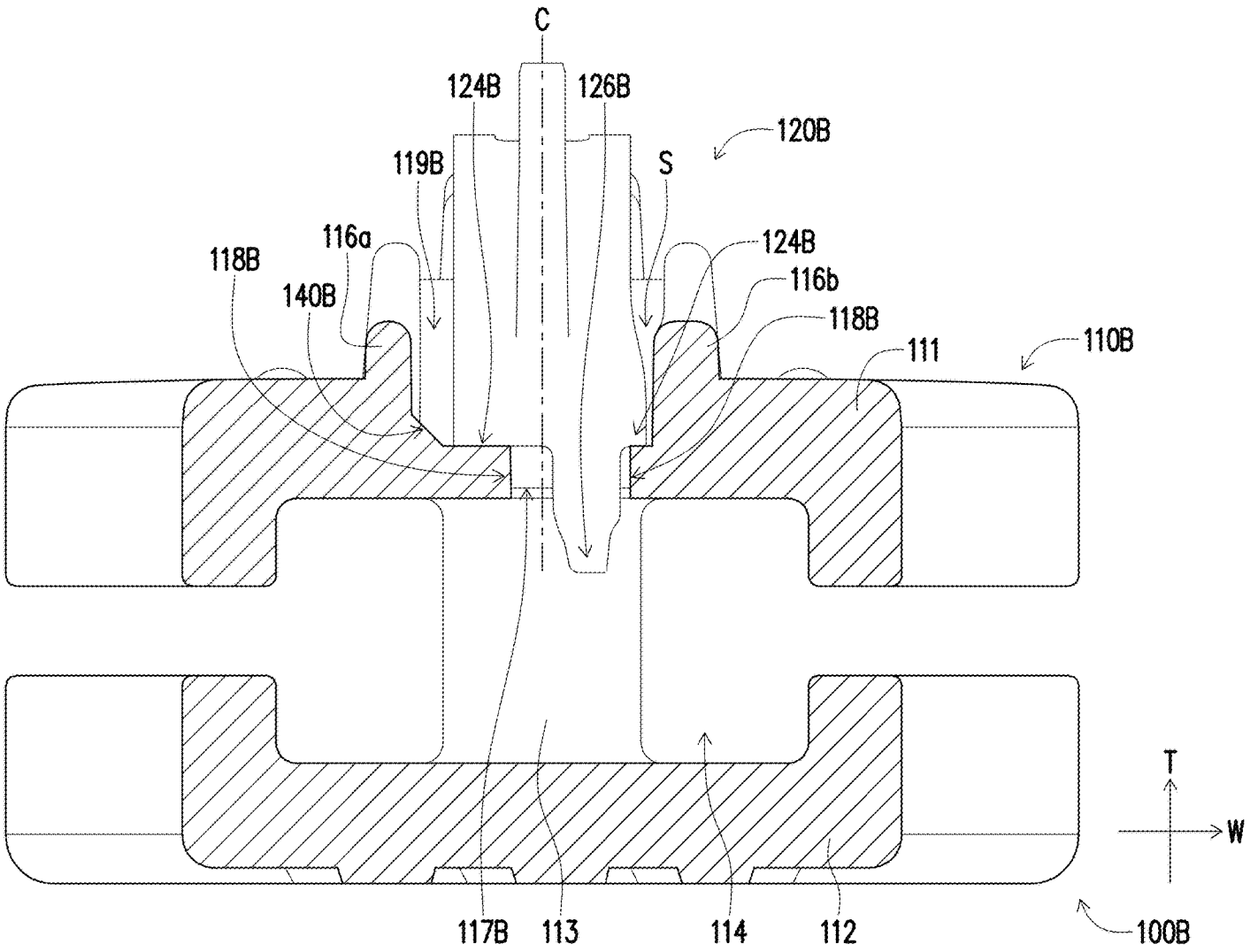
FIG. 10 is a cross-sectional schematic view of a local structure in the slider shown in FIG. 3 in a second modified example.

FIG. 1 is an exploded schematic view of a slider according to an embodiment of the present invention, FIG. 2 is a plan schematic view of a fastener chain provided with a separable pin applicable to the slider shown in FIG. 1, FIG. 3 is a cross-sectional schematic view of a local structure in the slider shown in FIG. 1, FIG. 4 is a cross-sectional schematic view of a pin portion of a lock pin of the slider shown in FIG. 3 being inserted into an element column passing through an element channel, FIG. 5 is a partially cut three-dimensional schematic view of the slider shown in FIG. 3 when the separable pin is inserted into the element channel, FIG. 6 is a cross-sectional schematic view of the slider shown in FIG. 3 when the separable pin is inserted into the element channel, FIG. 7 and FIG. 8 are operational schematic views of the pin portion of the lock pin of the slider shown in FIG. 6 when the separable pin is inserted into the element channel, FIG. 9 is a cross-sectional schematic view of a local structure in the slider shown in FIG. 3 in a first modified example, and FIG. 10 is a cross-sectional schematic view of a local structure in the slider shown in FIG. 3 in a second modified example. The specific structure, operating manner, etc. of a slider 100 according to an embodiment of the present invention will be illustrated below with FIG. 1 to FIG. 8, and the specific structure, operating manner, etc. of a slider 100A and a slider 100B in other modified examples will be illustrated below with FIG. 9 and FIG. 10, but the present invention is not limited thereto and may be adjusted according to requirements.

Please refer to FIG. 1 to FIG. 3. In the embodiment, the slider 100 is suitable for being installed on a fastener chain 50. As shown in FIG. 2, the fastener chain 50 includes a pair of fastener tapes 52 extending along a longitudinal direction L and a pair of element columns 54 disposed side by side at the inner edges of the pair of fastener tapes 52 along the longitudinal direction L. In addition, the fastener chain 50 is further provided with a separable pin 56 and a retainer pin 58. The separable pin 56 and the retainer pin 58 are respectively disposed on the pair of fastener tapes 52 and are located at the ends of the pair of element columns 54. The separable pin 56 and the retainer pin 58 may be engaged with each other to fix the end of the fastener chain 50. Correspondingly, as shown in FIG. 1 and FIG. 3, the slider 100 includes a slider body 110, a lock pin 120, and a tab pull 130. The slider body 110 is used to be installed on the fastener chain 50 as shown in FIG. 2. The lock pin 120 is disposed on the slider body 110 and extends toward an inner portion of the slider body 110. The tab pull 130 is disposed on the slider body 110 to drive the slider body 110 to slide relative to the fastener chain 50 to open or close the pair of element columns 54 disposed on the fastener chain 50 and may drive the lock pin 120 to move.

In this way, in the embodiment, when the element column 54 of the fastener chain 50 shown in FIG. 2 passes through the slider body 110, as shown in FIG. 4, the lock pin 120 may be inserted into the element column 54 on one side to lock the slider body 110 onto the fastener chain 50 (as described later). Furthermore, the lock pin 120 may be unlocked while the slider body 110 is driven to slide relative to the fastener chain 50 via the tab pull 130 (as described later). Furthermore, when the separable pin 56 disposed at the end of the element column 54 of the fastener chain 50 shown in FIG. 2 passes through the slider body 110, as shown in FIG. 5 and FIG. 6, the lock pin 120 extending toward the inner portion of the slider body 110 does not interfere with the separable pin 56 (as described later). The tab pull 130 and the installation structure thereof are omitted in FIG. 3 to FIG. 6 and subsequent FIG. 7 and FIG. 8 associated with FIG. 3 to FIG. 6 to facilitate illustrating the structures and relative relationship of the slider body 110, the lock pin 120, and a limiting portion 140. In addition, the element column 54 on one side is omitted in FIG. 4 to facilitate illustrating the structures and relative relationship of the lock pin 120 and the inserted element column 54. A part of the slider body 110 and the retainer pin 58 are omitted in FIG. 5 to facilitate illustrating the structures and relative relationship of the separable pin 56 and the lock pin 120 in the inner portion of the slider body 110. However, the present invention does not limit the application and operating means of the slider 100 on the fastener chain 50, nor does the present invention limit the specific structures and types of the slider 100 and the applied fastener chain 50, which may be adjusted according to requirements.

Specifically, in the embodiment, as shown in FIG. 1 and FIG. 3, the slider body 110 includes an upper blade 111 and a lower blade 112 disposed opposite to each other and a guide column 113 connecting the upper blade 111 and the lower blade 112, and has an element channel 114 located between the upper blade 111 and the lower blade 112. The upper blade 111 and the lower blade 112 are, for example, plate structures provided with side flanges, and the guide column 113 is disposed on a front side E1 of the slider body 110 to connect the upper blade 111 and the lower blade 112 to open or close the pair of element columns 54 when the slider body 110 slides relative to the fastener chain 50. In addition, the element channel 114 between the upper blade 111 and the lower blade 112 forms a double channel on the front side E1 via the separation by the guide column 113 to allow the element columns 54 that have not yet engaged to pass through and forms a single channel on a rear side E2 of the slider body 110 opposite to the guide column 113 to allow the element columns 54 that have engaged with each other to pass through. More specifically, the slider body 110 includes a pair of wall portions 116*a* and 116*b* disposed on the upper blade 111 and forming an accommodating space S for the lock pin 120, a pin hole 117 formed between the pair of wall portions 116*a* and 116*b* and communicated with the element channel 114, and a pedestal portion 118 disposed on at least one side of the pin hole 117 between the pair of wall portions 116*a* and 116*b* and on one of the pair of wall portions 116*a* and 116*b* to carry the lock pin 120. The embodiment shown in FIG. 3 is illustrated by disposing the pedestal portion 118 on the left side of the pin hole 117 and on the wall portion 116*a* on the left side as an example. For example, the pedestal portion 118 extends from a lower side of the wall portion 116*a* on the left side into the pin hole 117 (that is, toward the right side). However, in other embodiments not shown, the pedestal portion 118 may also be disposed on the right side of the pin hole 117 and on the wall portion 116*b* on the right side.

Correspondingly, in the embodiment, as shown in FIG. 1 and FIG. 3, the lock pin 120 has a holding portion 122 (labelled in FIG. 1) held on the front side E1 of the slider body 110, a placement portion 124 on the opposite side of the holding portion 122 and placed on the pedestal portion 118, and a pin portion 126 extending downward from the placement portion 124 and passing through the pin hole 117. In this way, the holding portion 122 of the lock pin 120 is configured as a fixed end fixed to the slider body 110, and the placement portion 124 and the pin portion 126 are configured as free ends that may move in the accommodating space S to facilitate locking or unlocking via the drive by the tab pull 130. Furthermore, in the state where the placement portion 124 is placed on the pedestal portion 118, the pin portion 126 further extends into the pin hole 117 next to the pedestal portion 118, so that the pin portion 126 may enter the element channel 114 of the slider body 110 and lock the element column 54 passing through one side of the element channel 114. The locking refers to that the slider body 110 cannot slide relative to the fastener chain 50, and the specific operating means will be described later. In addition, the tab pull 130 is disposed on the slider body 110. For example, an installation ring portion 132 of the tab pull 130 is installed on the slider body 110 through a tab pull ring portion 115 and the lock pin 120 disposed on an upper side of the slider body 110, so that the movement of the tab pull 130 may be linked to the lock pin 120 (as described later).

Furthermore, in the embodiment, as shown in FIG. 3, one of the pedestal portion 118 of the slider body 110 and the placement portion 124 of the lock pin 120 is provided with the limiting portion 140 for limiting the placement portion 124 in a width direction W. In the embodiment shown in FIG. 3, the limiting portion 140 is disposed on one side of the pedestal portion 118 opposite to the pin hole 117, such as being disposed at a corner between the pedestal portion 118 and the wall portion 116*a* provided with the pedestal portion 118, and limits the displacement of the placement portion 124 relative to the pedestal portion 118 in the width direction W. That is, in the state where the placement portion 124 is placed on the pedestal portion 118, one side (for example, the left side) of the placement portion 124 is abutted via the limiting portion 140 to suppress the displacement of the placement portion 124 in the width direction W. Preferably, the limiting portion 140 includes an inclined surface (for example, with an inclination angle of between 30 degrees and 60 degrees) inclined downward toward the pedestal portion 118 where the placement portion 124 is placed on. The inclined surface may be a plane as shown in FIG. 3 or may also be a protruding arc surface. In other embodiments not shown, the limiting portion 140 may also be a tiny protrusion (for example, with a height of between 0.05 mm and 0.1 mm) disposed on a surface of the pedestal portion 118 and close to the wall portion 116*a* (that is, the side opposite to the pin hole 117). The tiny protrusion may be a point or block protrusion or may also be a strip rib, etc. The present invention does not limit the specific structure of the limiting portion 140 disposed on the pedestal portion 118, which may be adjusted according to requirements. Furthermore, the present invention does not limit the setting position of the limiting portion 140. In the subsequent first modified example, the limiting portion may also be disposed on the placement portion of the lock pin and between the pin portion and the pedestal portion (as described later). As long as the limiting portion can limit the placement portion in the width direction, the setting position may be adjusted according to requirements.

Furthermore, in the embodiment, as shown in FIG. 3, in the accommodating space S formed by the pair of wall portions 116*a* and 116*b*, a void portion 119 for the placement portion 124 to move is disposed above the pedestal portion 118, and the placement portion 124 is spaced apart from an inner wall of one of the pair of wall portions 116*a* and 116*b* to form the void portion 119. That is, in the state of being placed on the pedestal portion 118, the placement portion 124 accommodated in the accommodating space S does not contact the wall portion 116*a* of the pair of wall portions

116*a* and 116*b* provided with the pedestal portion 118 and holds the void portion 119. In the embodiment shown in FIG. 3, the void portion 119 is formed by the placement portion 124 being spaced apart from the inner wall of the wall portion 116*a* on the left side. Preferably, the void portion 119 is located above the limiting portion 140 in the up-down direction (that is, a thickness direction T of the slider body 110). In this way, the void portion 119 may serve as a moving space for the placement portion 124 of the lock pin 120 after overcoming the limitation by the limiting portion 140 (as described later). However, the present invention does not limit the specific structure of the void portion 119, which may be adjusted according to requirements.

Furthermore, in the embodiment, the pin portion 126 of the lock pin 120 is offset (such as being offset to the right side) relative to a centerline C of the slider body 110 and may be inserted into one of the pair of element columns 54 (for example, the element column 54 on the right side) passing through the element channel 114. As an example, the placement portion 124 and the pin portion 126 are connected to each other to form an L-shaped structure. For example, the placement portion 124 extends toward the left side relative to the pin portion 126, so that the pin portion 126 is offset to the right side. Furthermore, the pedestal portion 118 is disposed on one side (for example, the left side) of the pin hole 117 and on one of the pair of wall portions 116*a* and 116*b* (for example, the wall portion 116*a* on the left side), so that the pin portion 126 passes through the pin hole 117 next to the pedestal portion 118, and the limiting portion 140 is disposed between one of the pair of wall portions 116*a* and 116*b* (for example, the wall portion 116*a* on the left side) and the placement portion 124. In this way, in the state where the placement portion 124 protruding toward the left side relative to the pin portion 126 is placed on the pedestal portion 118 disposed on the left side of the accommodating space S, one side (for example, the left side) of the placement portion 124 is limited via the abutment by the limiting portion 140, thereby suppressing the displacement of the placement portion 124 relative to the pedestal portion 118 on the left side in the width direction W (that is, suppressing the displacement of the placement portion 124 toward the left side in the width direction W).

However, in other embodiments not shown, the pin portion 126 of the lock pin 120 may be offset to the left side relative to the centerline C of the slider body 110 and may be inserted into the element column 54 on the left side passing through the element channel 114. In this case, the placement portion 124 extends toward the right side relative to the pin portion 126, so that the pin portion 126 is offset to the left side, the pedestal portion 118 is disposed on the right side of the pin hole 117 and on the wall portion 116*b* on the right side, so that the pin portion 126 passes through the pin hole 117 next to the pedestal portion 118, and the limiting portion 140 is disposed between the wall portion 116*b* on the right side and the placement portion 124 (that is, the right side of the placement portion 124 is limited via the abutment by the limiting portion 140), thereby suppressing the displacement of the placement portion 124 toward the right side in the width direction W. In other words, the positions, etc. of the pin portion 126, the placement portion 124, the pedestal portion 118 may be correspondingly adjusted according to requirements. Furthermore, the present invention does not limit the shape of the lock pin 120. In the subsequent second modified example, the lock pin may also be set to a T-shape (as described later). As long as the lock pin is provided with the placement portion placed on the pedestal portion and is provided with the pin portion extending downward and passing through the pin hole, the lock pin may be adjusted according to requirements.

It can be seen that in the embodiment, as shown in FIG. 2, in the state where the slider 100 (as shown by the dotted line in FIG. 2) is installed on the fastener chain 50, the slider body 110 as shown in FIG. 1 and FIG. 3 slides relative to the fastener chain 50 through the drive by the tab pull 130, thereby opening or closing the element columns 54. For example, the slider body 110 moves upward through the drive by the tab pull 130 to close the element columns 54 and moves downward through the drive by the tab pull 130 to open the element columns 54 (but not limited thereto). During this process, as shown in FIG. 4, since the pin portion 126 of the lock pin 120 is offset (such as being offset to the right side) relative to the centerline C of the slider body 110, when the pair of element columns 54 of the fastener chain 50 pass through the element channel 114 of the slider body 110, the pin portion 126 of the lock pin 120 may be inserted into the element column 54 on one side (for example, the element column 54 on the right side) among the pair of element columns 54 passing through the element channel 114 (such as being inserted between two elements in the element column 54) for locking, so that the slider body 110 cannot slide relative to the fastener chain 50, and the placement portion 124 may be limited via the limiting portion 140 to suppress the displacement in the width direction W, thereby ensuring the locking strength of the lock pin 120.

In addition, in the embodiment, since the slider 100 is further provided with the tab pull 130 linked with the lock pin 120, the lock pin 120 in the locked state of FIG. 4 may be unlocked via the drive by the tab pull 130. For example, when the tab pull 130 is pulled up, the tab pull 130 drives the lock pin 120 to move upward and leave the element column 54, so that the slider body 110 may slide on the fastener chain 50. During the sliding process of the slider body 110, the lock pin 120 remains in the unlocked state via the drive by the tab pull 130, so as to maintain a smooth sliding operation. At this time, the pin portion 126 of the lock pin 120 leaves the element column 54, but preferably, the placement portion 124 is still located in the accommodating space S and the pin portion 126 is still located in the element channel 114 to shorten the moving distance of the lock pin 120, so as to maintain stability (but not limited thereto). When the tab pull 130 is released (for example, the tab pull 130 is reset via an elastic component not shown), the tab pull 130 drives the lock pin 120 to move downward, so that the placement portion 124 of the lock pin 120 is placed on the pedestal portion 118 and the pin portion 126 is inserted into the element column 54 on one side of the fastener chain 50 for locking (that is, the state of FIG. 4). In this way, the slider body 110 may be locked onto the fastener chain 50 via the lock pin 120 with a good locking effect, and the lock pin 120 may also be simultaneously unlocked when the tab pull 130 is used to drive the slider body 110 to slide relative to the fastener chain 50.

Furthermore, in the embodiment, when the slider 100 (as shown by the dotted line in FIG. 2) moves to the end of the fastener chain 50, the tab pull 130 may continue to be used to drive the slider body 110 to pass through the separable pin 56 and the retainer pin 58 at the end, or the slider body 110 may also be directly driven by hand to pass through the separable pin 56 and the retainer pin 58 at the end (the latter is preferred). At this time, even if the pin portion 126 is located in the element channel 114, the pin portion 126 will not be inserted between the last element and the separable pin 56 or the retainer pin 58 for locking. That is, when the slider 100 (as shown by the dotted line in FIG. 2) moves to the end of the fastener chain 50, the slider body 110 will not be in the locked state regardless of whether the tab pull 130 is pulled. Correspondingly, the separable pin 56 and the retainer pin 58 are inserted into the slider body 110 from bottom to top. As shown in FIG. 5 and FIG. 6, since the pin portion 126 of the lock pin 120 is offset (such as being offset to the right side) relative to the centerline C of the slider body 110, when the retainer pin 58 on the left side of the fastener chain 50 is inserted into the slider body 110 and passes through the element channel 114 (the retainer pin 58 is omitted in FIG. 5 and is shown as being disposed on the left side in FIG. 6), the retainer pin 58 does not contact the pin portion 126 of the lock pin 120 and may smoothly pass through the element channel 114, and when the separable pin 56 disposed on the right side of the fastener chain 50 is inserted into the slider body 110 and passes through the element channel 114 (shown as being disposed on the right side in FIG. 5 and FIG. 6), the separable pin 56 contacts the pin portion 126 of the lock pin 120, but may also smoothly pass through the element channel 114.

Furthermore, in the embodiment, as shown in FIG. 5 and FIG. 6, since the void portion 119 for the placement portion 124 to move is disposed above the pedestal portion 118, when the separable pin 56 of the fastener chain 50 is inserted into the slider body 110 and passes through the element channel 114, as shown in the operational schematic views of FIG. 6 to FIG. 8, the pin portion 126 of the lock pin 120 may be pushed by the separable pin 56 to rotate (for example, the separable pin 56 located on the right side pushes the pin portion 126 offset to the right side to rotate toward the left side and upward in a clockwise direction), so as to move past the limiting portion 140 and move toward the void portion 119 above (for example, the pin portion 126 moves upward along a surface of the limiting portion 140). In other words, the limiting portion 140 limits the placement portion 124 in the width direction W (such as limiting the placement portion 124 from displacing toward the left side), but because the rotation of the pin portion 126 is accompanied by a moving component moving upward, the limitation by the limiting portion 140 can be overcome, and the pin portion 126 may move toward the void portion 119 disposed above the pedestal portion 118, thereby moving the pin portion 126 toward the direction of the centerline C to make way for the element channel 114 for the separable pin 56 to pass through. To sum up the characteristics of all the structures, the slider 100 of the embodiment can take into account both the locking strength of the lock pin 120 and the insertion effect of the separable pin 56, thereby having good operability.

However, the above manner of limiting the placement portion 124 in the width direction W by the limiting portion 140 (as shown in FIG. 4), the above manner of unlocking the lock pin 120 by the tab pull 130, and the above operating manner of pushing the pin portion 126 by the separable pin 56 (as shown in FIG. 6 to FIG. 8) are only examples. For example, in other embodiments not shown, in the case where the pin portion 126 of the lock pin 120 is offset to the left side relative to the centerline C of the slider body 110, the pin portion 126 may be inserted into the element column 54 on the left side passing through the element channel 114 for locking, and the limiting portion 140 is disposed on the right side to suppress the placement portion 124 from displacing to the right side in the width direction W. Furthermore, the separable pin 56 may be disposed at the end of the element column 54 on the left side and pass through the element channel 114 on the left side, and the pin portion 126 offset to the left side of the lock pin 120 may be pushed by the separable pin 56 on the left side to rotate, so as to move past the limiting portion 140 disposed on the right side and move toward the void portion 119 above. In this way, according to the modified forms of the above components such as the slider body 110, the lock pin 120, and the limiting portion 140, the limiting manner of the limiting portion 140, the unlocking manner of the tab pull 130, and the operating manner of the separable pin 56 may be adjusted according to requirements, and the present invention is not limited thereto.

So far, although the modified forms of the components such as the slider body 110, the lock pin 120, and the limiting portion 140 of the slider 100 have been described above, other modified examples are also included. For example, in the embodiment shown in FIG. 3, the pedestal portion 118 of the slider body 110 of the slider 100 is provided with the limiting portion 140 for limiting the placement portion 124 in the width direction W. Correspondingly, in the first modified example shown in FIG. 9, a placement portion 124A of a lock pin 120A of the slider 100A is provided with a limiting portion 140A for limiting the placement portion 124A in the width direction W. That is, the setting position of the limiting portion 140A is adjusted.

Specifically, in the first modified example shown in FIG. 9, the placement portion 124A of the lock pin 120A of the slider 100A is provided with the limiting portion 140A for limiting the placement portion 124A in the width direction W, wherein the limiting portion 140A is disposed on one side of the placement portion 124A adjacently connected to the pin portion 126A, such as being disposed at a corner between the placement portion 124A and the pin portion 126A, and limits the displacement of the placement portion 124A relative to a pedestal portion 118A in the width direction W. That is, in the state where the placement portion 124A is placed on the pedestal portion 118A, one side (for example, the left side) of the placement portion 124A is abutted via the limiting portion 140A to suppress unintended displacement of the placement portion 124A in the width direction W. Preferably, the limiting portion 140A includes an inclined surface (for example, with an inclination angle of between 30 degrees and 60 degrees) inclined downward from the placement portion 124A toward the pin portion 126A. The inclined surface may be a plane as shown in FIG. 9 or may also be a protruding arc surface. The present invention does not limit the specific structure of the limiting portion 140A disposed on the placement portion 124A, which may be adjusted according to requirements.

Furthermore, in the first modified example shown in FIG. 9, a slider body 110A of the slider 100A is also provided with a void portion 119A located above the pedestal portion 118A in the accommodating space S and for the placement portion 124A to move. Preferably, the void portion 119A is located above the limiting portion 140A in the up-down direction (that is, a thickness direction T of the slider body 110A). In this way, the void portion 119A may serve as a moving space for the placement portion 124A of the lock pin 120A after overcoming the limitation by the limiting portion 140A. In addition, in the first modified example shown in FIG. 9, the pin portion 126A of the lock pin 120A is offset (such as being offset to the right side) relative to the centerline C of the slider body 110A and may be inserted into one of the pair of element columns 54 (for example, the element column 54 on the right side) passing through the element channel 114. As an example, the placement portion 124A and the pin portion 126A are connected to each other to form an L-shaped structure, the pedestal portion 118A is disposed on one side (for example, the left side) of a pin hole 117A and on one of the pair of wall portions 116*a* and 116*b* (for example, the wall portion 116*a* on the left side), so that the pin portion 126A passes through the pin hole 117A next to the pedestal portion 118A, and the limiting portion 140A is disposed between the pin portion 126A and the pedestal portion 118A. In this way, in the state where the placement portion 124A protruding toward the left side relative to the pin portion 126A is placed on the pedestal portion 118A disposed on the left side of the accommodating space S, one side (for example, the left side) of the placement portion 124A is limited via the abutment by the limiting portion 140A, thereby suppressing the displacement of the placement portion 124A toward the left side in the width direction W.

It can be seen that in the first modified example shown in FIG. 9, the slider 100A may also have the three-dimensional structure (that is, including the slider body 110A, the lock pin 120A, the tab pull 130, and the limiting portion 140A) as the slider 100 shown in FIG. 1 and be installed on the fastener chain 50 shown in FIG. 2. The main difference between the slider 100A and the slider 100 aforementioned is that the setting position of the limiting portion 140A is different from the setting position of the limiting portion 140, and the slider body 110A and the lock pin 120A are adjusted in response to the setting position of the limiting portion 140A. However, according to the specific structures and setting positions of the slider body 110A, the lock pin 120A, and the limiting portion 140A, the slider 100A may also have the same operating manner as the slider 100. That is, in the state where the slider 100A is installed on the fastener chain 50 (as shown in FIG. 2), the slider body 110A slides relative to the fastener chain 50 through the drive by the tab pull 130, thereby opening or closing the element columns 54. During this process, when the pair of element columns 54 of the fastener chain 50 passes through the element channel 114 of the slider body 110A, the pin portion 126A of the lock pin 120A may be inserted into the element column 54 on one side (for example, the element column 54 on the right side) passing through the element channel 114 as the pin portion 126 shown in FIG. 4 for locking, and the placement portion 124A may suppress the displacement in the width direction W via the limitation by the limiting portion 140A, thereby ensuring the locking strength of the lock pin 120A. Subsequently, the lock pin 120A in the locked state may be unlocked via the drive by the tab pull 130. In this way, the slider body 110A may be locked onto the fastener chain 50 via the lock pin 120A with a good locking effect, and the lock pin 120A may also be simultaneously unlocked when the tab pull 130 is used to drive the slider body 110A to slide relative to the fastener chain 50.

Furthermore, in the first modified example shown in FIG. 9, during the sliding process of the slider body 110A, the lock pin 120A maintains the unlocked state via the drive by the tab pull 130. During this process, when the separable pin 56 of the fastener chain 50 shown in FIG. 5 and FIG. 6 is inserted into the slider body 110A and passes through the element channel 114, the pin portion 126A of the lock pin 120A may be pushed by the separable pin 56 to rotate as the pin portion 126 shown in the operational schematic views of FIG. 6 to FIG. 8, so as to move past the limiting portion 140A and move toward the void portion 119A above. In other words, the limiting portion 140A limits the placement portion 124A in the width direction W (such as limiting the displacement of the placement portion 124A toward the left side), but because the rotation of the pin portion 126A is accompanied by a moving component moving upward, the limitation by the limiting portion 140A can be overcome, and the pin portion 126A may move toward the void portion 119A disposed above the pedestal portion 118A, thereby moving the pin portion 126A toward the direction of the centerline C to make way for the element channel 114 for the separable pin 56 to pass through. It can be seen that the present invention does not limit the setting positions of the limiting portions 140 and 140A, which may be adjusted according to requirements. To sum up the characteristics of all the structures, the slider 100A of the embodiment can take into account both the locking strength of the lock pin 120A and the insertion effect of the separable pin 56, thereby having good operability.

In addition, in the embodiment shown in FIG. 3, the placement portion 124 and the pin portion 126 of the lock pin 120 are connected to each other to form an L-shaped structure, wherein the pedestal portion 118 is disposed on one side (for example, the left side) of the pin hole 117 and on one of the pair of wall portions 116*a* and 116*b* (for example, the wall portion 116*a* on the left side), so that the pin portion 126 passes through the pin hole 117 next to the pedestal portion 118, and the limiting portion 140 is disposed between one of the pair of wall portions 116*a* and 116*b* (for example, the wall portion 116*a* on the left side) and the placement portion 124. In the first modified example shown in FIG. 9, the placement portion 124A and the pin portion 126A of the lock pin 120A are connected to each other to form an L-shaped structure, and the limiting portion 140A is disposed between the pin portion 126A and the pedestal portion 118A. Correspondingly, in the second modified example shown in FIG. 10, a placement portion 124B and a pin portion 126B of a lock pin 120B of the slider 100B are connected to each other to form a T-shaped structure, wherein a pair of pedestal portions 118B are disposed on two opposite sides of a pin hole 117B and on both of the pair of wall portions 116*a* and 116*b*, so that the pin portion 126B passes through the pin hole 117B between the pair of the pedestal portions 118B, and the limiting portion 140B is disposed between one of the pair of wall portions 116*a* and 116*b* (for example, the wall portion 116*a* on the left side) and the placement portion 124B.

Specifically, in the second modified example shown in FIG. 10, the pin portion 126B of the lock pin 120B is offset (such as being offset to the right side) relative to the centerline C of the slider body 110B and may be inserted into one of the pair of element columns 54 (for example, the element column 54 on the right side) passing through the element channel 114. As an example, the placement portion 124B and the pin portion 126B of the lock pin 120B of the slider 100B are connected to each other to form a T-shaped structure. For example, the pair of placement portions 124B respectively extend toward the left side and the right side relative to the pin portion 126B, and the size of the placement portion 124B on the left side in the width direction W is greater than the size of the placement portion 124B on the right side in the width direction W, so that the pin portion 126B is offset to the right side. Furthermore, the pair of pedestal portions 118B are disposed on the slider body 110B in response to the pair of placement portions 124B and are located on two opposite sides of the pin hole 117B and on both of the pair of wall portions 116*a* and 116*b*, so that the pin portion 126B passes through the pin hole 117B between the pair of pedestal portions 118B. Furthermore, the limiting portion 140B is disposed between one of the pair of wall portions 116*a* and 116*b* (for example, the wall portion 116*a* on the left side) and the placement portion 124B. That is, although the pair of placement portions 124B and the pair of pedestal portions 118B are provided, it is preferred to provide the limiting portion 140B on one side (but the present invention does not exclude the practice of providing the pair of limiting portions 140B). In this way, in the state where the pair of placement portions 124B are placed on the pair of pedestal portions 118B disposed on two opposite sides of the accommodating space S, one side (for example, the left side) of the placement portion 124B is limited via the abutment by the limiting portion 140B, thereby suppressing the displacement of the placement portion 124B toward the left side in the width direction W.

Furthermore, in the second modified example shown in FIG. 10, the slider body 110B of the slider 100B is also provided with a void portion 119B located above the pedestal portion 118B in the accommodating space S and for the placement portion 124B to move. Preferably, the void portion 119B is located above the limiting portion 140B in the up-down direction (that is, a thickness direction T of the slider body 110B). In this way, the void portion 119B may serve as a moving space for the placement portion 124B of the lock pin 120B after overcoming the limitation by the limiting portion 140B. In addition, in the second modified example shown in FIG. 10, the limiting portion 140B is disposed between one of the pair of wall portions 116*a* and 116*b* (for example, the wall portion 116*a* on the left side) and the placement portion 124B, and limits the displacement of the placement portion 124B relative to the pedestal portion 118B in the width direction W, but in other embodiments not shown, the limiting portion 140B may also be disposed on one side (which may be an inclined surface, etc.) of the placement portion 124B adjacently connected to the pin portion 126B and disposed between the pin portion 126B and one of the pedestal portions 118B.

It can be seen that in the second modified example shown in FIG. 10, the slider 100B may also have the three-dimensional structure (that is, including the slider body 110B, the lock pin 120B, the tab pull 130, and the limiting portion 140B) as the slider 100 shown in FIG. 1 and be installed on the fastener chain 50 shown in FIG. 2. The main difference between the slider 100B and the slider 100 is that the specific structures of the slider body 110B and the lock pin 120B are different from the specific structures of the slider body 110 and the lock pin 120. However, according to the specific structures and setting positions of the slider body 110B, the lock pin 120B, and the limiting portion 140B, the slider 100B may also have the same operating manner as the slider 100. That is, in the state where the slider 100B is installed on the fastener chain 50 (as shown in FIG. 2), the slider body 110B slides relative to the fastener chain 50 through the drive by the tab pull 130, thereby opening or closing the element columns 54. During this process, when the pair of element columns 54 of the fastener chain 50 passes through the element channel 114 of the slider body 110B, the pin portion 126B of the lock pin 120B may be inserted into the element column 54 on one side (for example, the element column 54 on the right side) passing through the element channel 114 as the pin portion 126 shown in FIG. 4 for locking, and the placement portion 124B may suppress the displacement in the width direction W via the limitation by the limiting portion 140B, thereby ensuring the locking strength of the lock pin 120B. Subsequently, the lock pin 120B in the locked state may be unlocked via the drive by the tab pull 130. In this way, the slider body 110B may be locked onto the fastener chain 50 via the lock pin 120B with a good locking effect, and the lock pin 120B may also be simultaneously unlocked when the tab pull 130 is used to drive the slider body 110B to slide relative to the fastener chain 50.

Furthermore, in the second modified example shown in FIG. 10, during the sliding process of the slider body 110B, the lock pin 120B maintains the unlocked state via the drive by the tab pull 130. During this process, when the separable pin 56 of the fastener chain 50 shown in FIG. 5 and FIG. 6 is inserted into the slider body 110B and passes through the element channel 114, the pin portion 126B of the lock pin 120B may be pushed by the separable pin 56 to rotate as the pin portion 126 shown in the operational schematic views of FIG. 6 to FIG. 8, so as to move past the limiting portion 140B and move toward the void portion 119B above. In other words, the limiting portion 140B limits the placement portion 124B in the width direction W (such as limiting the displacement of the placement portion 124B toward the left side), but because the rotation of the pin portion 126B is accompanied by a moving component moving upward, the limitation by the limiting portion 140A can be overcome, and the pin portion 126B may move toward the void portion 119B disposed above the pedestal portion 118B, thereby moving the pin portion 126B toward the direction of the centerline C to make way for the element channel 114 for the separable pin 56 to pass through. It can be seen that the present invention does not limit the specific structures of the slider bodies 110 and 110B and the lock pins 120 and 120B, which may be adjusted according to requirements. To sum up the characteristics of all the structures, the slider 100B of the embodiment can take into account both the locking strength of the lock pin 120B and the insertion effect of the separable pin 56, thereby having good operability.

In summary, in the slider of the present invention, one of the pedestal portion of the slider body and the placement portion of the lock pin is provided with the limiting portion for limiting the placement portion in the width direction, and in the accommodating space formed by the pair of wall portions of the slider body, the void portion for the placement portion to move is disposed above the pedestal portion, and the placement portion is spaced apart from the inner wall of one of the pair of wall portions to form the void portion. Preferably, the pin portion of the lock pin is offset relative to the centerline of the slider body. In this way, when the pair of element columns of the fastener chain pass through the element channel of the slider body, the pin portion of the lock pin may be inserted into the element column on one side for locking, and the placement portion may suppress the displacement in the width direction via the limitation by the limiting portion, thereby ensuring the locking strength of the lock pin. Correspondingly, when the separable pin of the fastener chain is inserted into the slider body and passes through the element channel, the pin portion of the lock pin may be pushed by the separable pin to rotate, so as to move past the limiting portion and move toward the void portion, thereby preventing the lock pin from interfering with the insertion of the separable pin. Accordingly, the slider of the present invention can take into account both the locking strength of the lock pin and the insertion effect of the separable pin, thereby having good operability.

Finally, it should be noted that the above embodiments are only used to illustrate, but not to limit, the technical solutions of the present invention. Although the present invention has been described in detail with reference to the above embodiments, persons skilled in the art should understand that the technical solutions described in the above embodiments may still be modified or some or all of the technical features thereof may be equivalently replaced. However, the modified examples or replacements do not cause the essence of the corresponding technical solutions to deviate from the scope of the technical solutions of the embodiments of the present invention.

What is claimed is:

1. A slider, suitable for being installed on a fastener chain and comprising:

a slider body, comprising an upper blade and a lower blade disposed opposite to each other and a guide column connecting the upper blade and the lower blade, and having an element channel located between the upper blade and the lower blade;

a lock pin, disposed on the slider body; and a tab pull, disposed on the slider body and driving the lock pin to move, wherein the slider body has a pair of wall portions disposed on the upper blade and forming an accommodating space for the lock pin, a pin hole formed between the pair of wall portions and communicated with the element channel, and a pedestal portion disposed on at least one side of the pin hole between the pair of wall portions and on one of the pair of wall portions to carry the lock pin, the lock pin has a holding portion held on a front side of the slider body, a placement portion on an opposite side of the holding portion and placed on the pedestal portion, and a pin portion extending downward from the placement portion and passing through the pin hole, one of the pedestal portion and the placement portion is provided with a limiting portion for limiting the placement portion in a width direction, and in the accommodating space, a void portion for the placement portion to move obliquely upward in the width direction through a guidance of the limiting portion when the pin portion is pushed by a separable pin of the fastener chain in the width direction is disposed above the pedestal portion, the placement portion is spaced apart from an inner wall of one of the pair of wall portions to form the void portion.

2. The slider according to claim 1, wherein the void portion is located above the limiting portion in an up-down direction.

3. The slider according to claim 1, wherein the limiting portion is disposed on one side of the pedestal portion opposite to the pin hole and limits displacement of the placement portion relative to the pedestal portion in the width direction.

4. The slider according to claim 3, wherein the limiting portion comprises an inclined surface inclined downward toward the pedestal portion where the placement portion is placed on.

5. The slider according to claim 1, wherein the limiting portion is disposed on one side of the placement portion adjacently connected to the pin portion and limits displacement of the placement portion relative to the pedestal portion in the width direction.

6. The slider according to claim 5, wherein the limiting portion comprises an inclined surface inclined downward from the placement portion toward the pin portion.

7. The slider according to claim 1, wherein the placement portion and the pin portion are connected to each other to form an L-shaped structure, the pedestal portion is disposed on one side of the pin hole and on one of the pair of wall portions, so that the pin portion passes through the pin hole next to the pedestal portion, and the limiting portion is disposed between one of the pair of wall portions and the placement portion or disposed between the pin portion and the pedestal portion.

8. The slider according to claim 1, wherein the placement portion and the pin portion are connected to each other to form a T-shaped structure, a pair of the pedestal portions are disposed on two opposite sides of the pin hole and on both of the pair of wall portions, so that the pin portion passes through the pin hole between the pair of the pedestal portions, and the limiting portion is disposed between one of the pair of wall portions and the placement portion or disposed between the pin portion and one of the pedestal portions.

9. The slider according to claim 1, wherein the pin portion of the lock pin is offset relative to a centerline of the slider body and is capable of being inserted into one of a pair of element columns passing through the element channel.

10. The slider according to claim 1, wherein when the separable pin of the fastener chain passes through the element channel of the slider body, the pin portion is pushed by the separable pin to rotate, so as to move past the limiting portion and move toward the void portion.

* * * * *